US007952554B2

(12) United States Patent
Awakura et al.

(10) Patent No.: US 7,952,554 B2
(45) Date of Patent: May 31, 2011

(54) DISPLAY DRIVER AND DISPLAY DRIVING METHOD

(75) Inventors: Hiroki Awakura, Yokohama (JP); Yasuyuki Kudo, Fujisawa (JP); Takashi Shoji, Fujisawa (JP); Shigeru Ota, Higashimurayama (JP)

(73) Assignee: Renesas Electronics Corporation, Kawasaki (JP)

( * ) Notice: Subject to any disclaimer, the term of this patent is extended or adjusted under 35 U.S.C. 154(b) by 979 days.

(21) Appl. No.: 11/749,270

(22) Filed: May 16, 2007

(65) Prior Publication Data

US 2007/0291021 A1 Dec. 20, 2007

(30) Foreign Application Priority Data

May 17, 2006 (JP) ..... 2006-137357

(51) Int. Cl.
*G09G 5/00* (2006.01)

(52) U.S. Cl. ..... 345/100; 345/204

(58) Field of Classification Search ..... 345/87, 345/98–100, 204, 76, 82, 205
See application file for complete search history.

(56) References Cited

U.S. PATENT DOCUMENTS

| | | | | |
|---|---|---|---|---|
| 6,140,996 | A * | 10/2000 | Nobutani et al. | 715/856 |
| 7,123,247 | B2 | 10/2006 | Morita et al. | |
| 2003/0169244 | A1 | 9/2003 | Kurokawa et al. | |
| 2004/0233152 | A1 * | 11/2004 | Wang et al. | 345/98 |

FOREIGN PATENT DOCUMENTS

| | | |
|---|---|---|
| JP | 03-144492 | 6/1991 |
| JP | 2003-058130 | 2/2003 |
| JP | 2003-330433 | 11/2003 |

* cited by examiner

*Primary Examiner* — Stephen G Sherman
(74) *Attorney, Agent, or Firm* — Mattingly & Malur, PC

(57) ABSTRACT

In a liquid crystal driver of a liquid crystal display having a structure to switch between image data for partial display from a partial memory and non-display (background pattern), changes in a partial-display area are detected according to a setting command of the partial-display area, and a mask switch is controlled so as to select the background pattern. Timing to write to the last line of the changed partial-display area in the partial memory is determined by an address counter for controlling the partial memory, and the mask switch is controlled so as to select the image data of the partial memory from a next frame.

7 Claims, 6 Drawing Sheets

BEFORE UPDATE

DURING UPDATE

BEFORE UPDATE

DURING UPDATE

AFTER UPDATE

BEFORE UPDATE

DURING UPDATE

AFTER UPDATE

DISPLAY DRIVER AND DISPLAY DRIVING METHOD

CROSS-REFERENCE TO RELATED APPLICATION

The present application claims priority from Japanese Patent Application No. JP 2006-137357 filed on May 17, 2006, the content of which is hereby incorporated by reference into this application.

BACKGROUND OF THE INVENTION

The present invention relates to a display driver which drives an image display device such as a Liquid Crystal Display, and more particularly, to a technique effectively applied to a drive circuit and a driving method of an active-matrix display device which is capable of partial display.

For example, active-matrix display devices are used for mobile devices such as mobile phones and handheld terminals, due to them having characteristics of being thin, light, and having low power consumption. For mobile devices, generally the power supply consists of batteries and so improvements in lowering power consumption are required. However, in recent years, while the progress of higher resolution displays due to demands with respect to improvements in viewability and image quality has increased, the power consumption of these devices has also increased. To solve this problem, it is known that a partial display technique is effective, which achieves low power consumption by displaying only a minimum required part in the display during standby or in a power-saving mode.

Further, for LCDs, to prevent burn-in which leads to image deterioration, reversed-polarity voltages corresponding to image data at a constant frequency must be applied to the liquid crystals. Therefore, even for still images, it is necessary to execute image data transfer from a system of a previous stage such as a microprocessor (MPU: Micro Processing Unit) which increases power consumption and the load on the MPU. To solve this problem, liquid crystal drivers are made to store image data by embedding memories to store image data of one screen image. Accordingly, it is possible to apply reversed-polarity voltages to liquid crystals in a constant frequency using the stored image data while displaying a still image. Reducing transfers of the MPU to reduce power and load thereon is thus achieved in this way. However, as the progress in higher resolution displays in recent years has continued, if the memory having a capacity for one screen image is equipped in the liquid crystal driver, it is expected to have a large increase in cost. To solve this problem, low power consumption and low cost are achieved by equipping only memories having a capacity for partial display (partial memory) on the liquid crystal driver.

The area of this partial display may be used in different ways according to specific terminals and applications. Therefore, for example, as disclosed in U.S. Pat. No. 7,123,247 (Japanese Patent Application Laid-Open Publication No. 2003-58130), it is possible to meet various requirements for terminals and applications by equipping a structure where it is capable of arbitrarily setting a partial-display area limited to the physical size of a partial memory.

SUMMARY OF THE INVENTION

Meanwhile, when the technology described above is utilized, on an occasion where an update of partial-display data and a partial-display area is made by an MPU during a partial-display mode, the display is updated at the time a partial-display area setting is transferred from the MPU, and a time difference between the setting and the partial-display data occurs, so that it makes a display of updated data transferred per frame.

For example, when updating 16-bit partial-display data of 96×320 size by 10 MHz serial data transfer from an MPU, it requires about 49 ms from the start of transfer to the end of transfer. That is, it needs a 3-frame period with a 60 Hz frame frequency. The slower the transfer speed is, the greater the interval becomes.

There occurs an interval between setting of an area and updating an image because the update of a partial-display area setting is made before or after the partial-display data transfer. This is shown in FIGS. 6A to 6B. A partial display before update is shown in FIG. 6A, a partial display during data transfer after updating a partial-display area 201-*a* with 201-*b* is shown in FIG. 6B, and a partial display after update is shown in FIG. 6C. Note that, correspondingly, a non-partial-display area is updated from 205-*a* to 205-*b*.

When a horizontal width in the area is changed due to the update, as shown in FIG. 6B, it causes a display to be generated having a destroyed relation between the partial-display data and the partial-display area during a transfer period of the partial-display data.

An object of the present invention is therefore providing a driving technique of a display device capable of achieving low power partial display while displaying a high quality image and providing various displays which, by avoiding image distortion in partial display which occurs when switching image data along with changes of partial-display area, display a high quality image.

The present invention aims to provide a drive circuit and a driving method for display devices having a structure where switching of image data of a partial display from a partial memory and no display (background pattern) is made, to realize the above object.

A register capable of controlling external commands is prepared to control a switch so as to select a background pattern during changing a partial-display area. When an update ends, the switch is controlled so as to control image data of a partial memory. By this means, the display is the background pattern over the whole screen until the image data is switched according to setting a change of the partial-display area, thereby preventing displaying an image with image distortion.

Further, in a case where the change of the partial-display area is automatically detected, the change of partial-display area is detected according to a command of setting the partial-display area to control the switch so as to select the background pattern. A timing of writing to the last line of the changed partial-display area in the partial memory is estimated by an address counter which controls the partial memory to control the switch so as to select image data of the partial memory from the next frame. Also in a case where the change of the partial-display area is automatically detected, similarly the display is the background color over the whole screen until image data is switched after setting a change of partial-display area, thereby preventing displaying an image with image distortion.

According to the present invention, display distortion in a partial display which occurs when switching image data along with a change of the partial-display area can be prevented. Further, the change is detected automatically, thereby enabling a partial display with a high-quality image and no display distortion, without letting users be conscious of that.

BRIEF DESCRIPTIONS OF THE DRAWINGS

DESCRIPTIONS OF THE PREFERRED EMBODIMENTS

Hereinafter, embodiments of the present invention will be described in detail with reference to the accompanying drawings. Note that components having the same function are denoted by the same reference symbols throughout the drawings for describing the embodiment, and the repetitive description thereof will be omitted.

First Embodiment

A display driver and a driving method of an active-matrix display device according to a first embodiment of the present invention will be described with reference to FIG. 1 to FIG. 3. In this case, although a liquid crystal display device is described as one example of the active-matrix display device, it is applicable to other display devices such as organic EL display.

Figure 1:
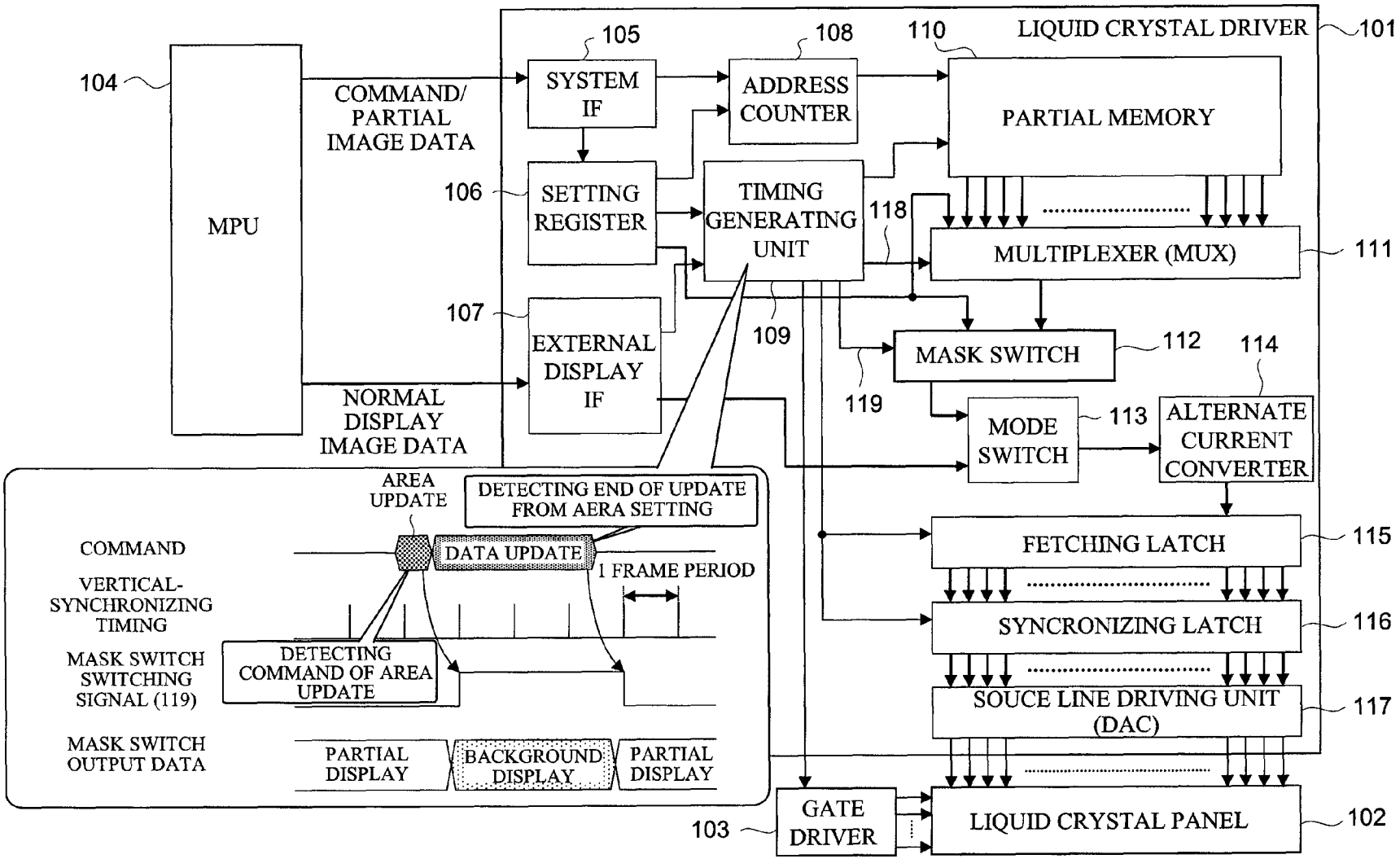
FIG. 1 is a block diagram showing a liquid crystal driver of a liquid crystal display according to a first embodiment of the present invention and a connection relation with external devices thereof.

FIG. 1 shows a block diagram showing a liquid crystal driver of a liquid crystal display according to the first embodiment of the present invention and a connection relation with external devices thereof.

In FIG. 1, 101 indicates a liquid crystal driver as the display driver of the present invention, 102 indicates a liquid crystal panel of a so-called active-matrix type, in which liquid crystal pixels are each connected to a data line via a thin film transistor (TFT) and sandwiched between a pixel electrode and a common electrode are arranged on intersections of a plurality of scanning lines and a plurality of data lines. Reference numeral 103 indicates a gate driver which drives the scanning lines of the liquid crystal panel 102, reference numeral 104 indicates an MPU which controls the liquid crystal panel 102 and other external devices.

In addition, the liquid crystal driver 101 is configured by: a system interface (IF) 105; a setting register 106; an external display interface (IF) 107; an address counter 108; a timing generating unit 109; a partial memory 110; a multiplexer (MUX) 111; a mask switch 112; a mode switch 113; an alternate-current converter; a fetching latch 115; a synchronizing latch 116; and a data line driving unit (DAC).

First, operations of the MPU 104, the liquid crystal driver 101, and the liquid crystal panel 102 will be described.

The MPU 104 transfers display data for displaying images on the liquid crystal panel 102, various commands such as operation mode, and respective driving parameters of the liquid crystal panel 102 to the liquid crystal driver 101. The respective driving parameters include, besides panel interface control and driving voltage control, settings of such as: display timing in a low-power partial-display mode; an area setting of partial display; and a pattern to be displayed in an region other than the area of partial display, e.g., a color of a solid pattern (referred to as a background color, hereinafter), the settings are stored to the setting register 106 by the system interface 105. The various commands such as operation mode include: start of oscillation of internal clock; timing of power supply to the liquid crystal panel 102; start of data transfer to the partial memory; and the like. And moreover, as features of the present invention, validation of partial display to display the display data in the partial memory 110 and invalidation of partial display to display the background color are included.

The display data, various commands, respective driving parameters transferred from the MPU 104 are executed by the MPU 104 corresponding to a sequence programmed beforehand based on an operation from an external of a system on which the present display device is mounted, environment, and situation.

In a normal display period to display in the whole area of a display area of the liquid crystal panel 102, display data is inputted to the external display interface 107 from the MPU 104 as needed with a timing signal synchronized with display timing of the liquid crystal panel 102, and the mode switch 113 selects display data from the external display interface 107. Then, in the alternate-current converter 114, the display data is converted to accommodate alternate current, and data for one display line is: buffered in the fetching latch 115; synchronized with scanning timing of the gate driver 113 by the synchronizing latch 116; and converted to an analog voltage from digital data to drive the data line in the DAC 117, and then the display data is displayed on the liquid crystal panel 102.

The mode switch operates a control by setting a register for setting either the normal display mode or the partial-display mode in the setting register 106 to the normal display mode.

The partial-display period relating to the present invention to display images in an arbitrary area in the display area, which is smaller than the display area will be described with reference to FIG. 2. An update command of partial-display data is inputted to the system interface 105 from the MPU 104 at the time of display-data update of the partial-display data, and the partial-display data is once stored in the partial memory 110 according to an address control of the address counter 108.

Figure 2B:
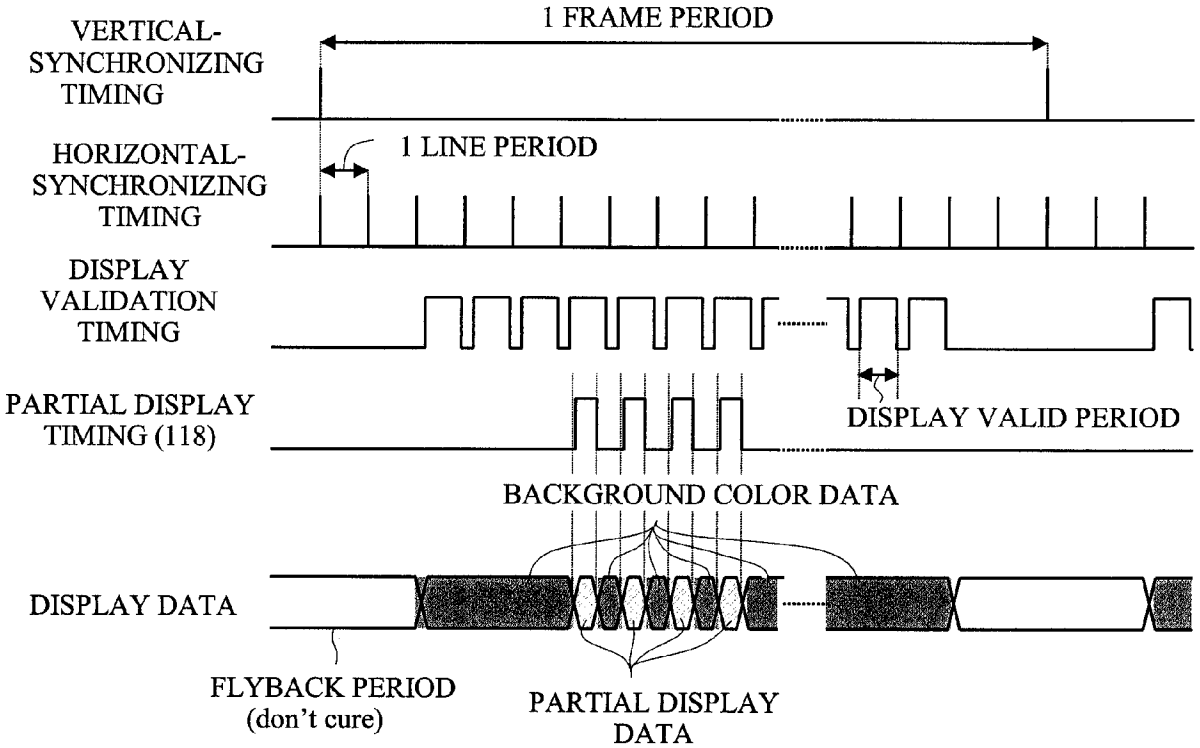
FIG. 2B is a timing chart of a partial display according to the first embodiment of the present invention.
Figure 2A:
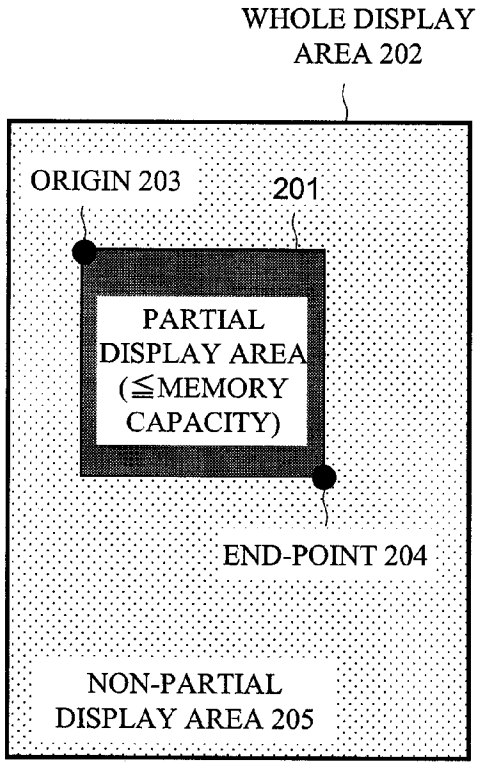
FIG. 2A is an explanatory diagram showing a partial-display area according to the first embodiment of the present invention.

The address counter 108 updates the display data by an address control of the memory according to settings of partial-display area stored in the setting register 106, for example, as shown in FIG. 2A, information capable of distinguishing the area like coordinates of the upper-left point (origin 203) and the bottom-right point (end-point 204) of the rectangular area with respect to the whole display area or an origin and a size of the area (height, width), and position information of pixels to be updated and display data.

In this case, the setting of partial-display area 201 is stored in the setting register 106 by the MPU 104 via the system interface 105 before transferring the partial-display data.

The display data stored in the partial memory 110 is read from the partial memory 110 at partial-display timing (signal) 118 generated in the timing generating unit 109, according to output timing stored in the setting register and the setting of partial-display area 201.

The partial-display data is transferred by the MUX 111 matching the timing of the partial-display area 201. At the display timing of the area other than the partial-display area (hereinafter, referred to as non-partial-display area 205), the background color data set in the setting register 106 is inserted.

In a timing chart of FIG. 2B, a relation among display reference timing (horizontal synchronizing timing, vertical synchronizing timing, display valid timing), the partial-display timing 118, and the display data is shown.

According to the partial-display timing 118, if an update operation of the partial-display data and the partial-display area 201 is generated by the MPU 104 during the partial-display mode, the display is updated at the time when the setting of partial-display area 201 is transferred from the MPU 104, and further, there occurs a time difference with respect to the transfer of the partial-display data. Accordingly, the display is updated by the transferred data per frame.

There occurs a difference between the setting of the area and the image updating due to the setting of the partial-display area 201 updated before or after transferring the partial-display data.

Figure 6A:
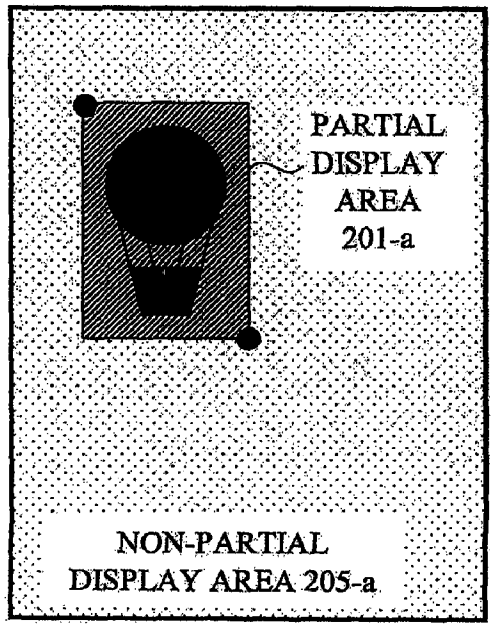
FIG. 6A Prior Art
FIG. 6A is an image diagram in a data-update period showing a partial display before update according to a comparative art to the present invention.
Figure 6B:
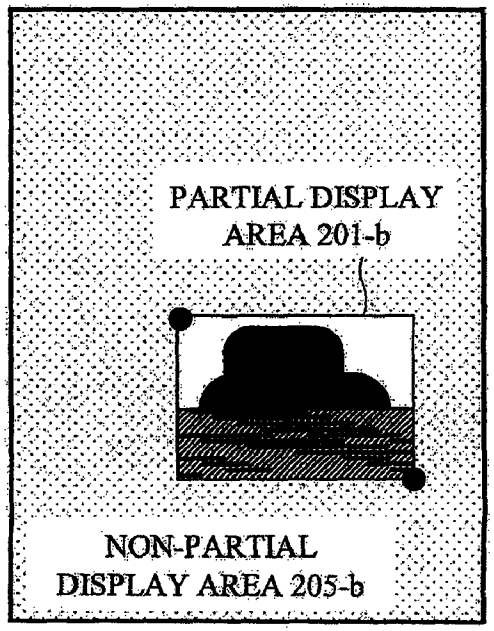
FIG. 6B Prior Art
FIG. 6B is an image diagram in the data-update period showing a partial display during update according to the comparative art to the present invention.
Figure 6C:
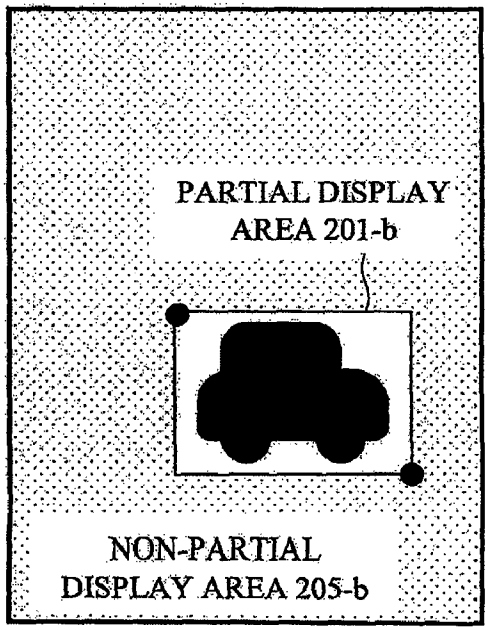
FIG. 6C Prior Art
FIG. 6C is an image diagram in the data-update period showing a partial display after update according to the comparative art to the present invention.

If the horizontal width of the area is changed by the update, as shown in FIG. 6 described the above summary, there occurs a display where the relation between the partial-display data and the partial-display area is destroyed for just the transfer period of the partial-display data.

Consequently, in the present invention, the mask switch 112 as a switching means is provided after the MUX 111 to provide a structure for masking the transfer period of the partial-display data. The mask switch 112 switches the output data from the MUX 111 including the partial-display data to the background pattern including background colors and the like.

In this case, for the background pattern, it is possible to specify colors in a solid pattern by the register in the present embodiment. However, a fixed color, or checkered pattern, striped pattern, and any pattern which are image-size independent are also available.

By the switching control of the mask switch 112, the update command of the partial-display area from the MPU 104 is detected to validate the background pattern.

By the setting of the partial-display area, an end-point of the data transfer, i.e., a write address to the partial memory can be computed, thereby invalidating the background pattern at the timing when the end-point data is read and validating the display data from the MUX 111 including the partial-display data. A mask-switch-switching signal 119 for this manner is generated in the timing generating unit 109 as a generating means.

For example, when updating 16-bit partial-display data of 96×320 size by 10 MHz serial data transfer from the MPU 104, it requires about 49 ms from the start to the end of the transfer, that is, a three-frame period with a 60 Hz frame frequency. The background pattern is validated for the three-frame period.

Further, when the mask-switch-switching signal 119 is synchronized with the vertical-synchronizing timing of display output, the display will not be switched in the midst of displaying one screen.

Figure 3A:
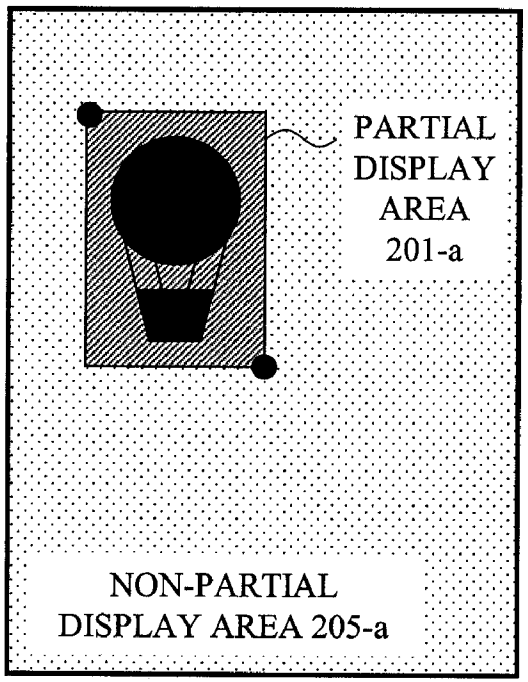
FIG. 3A is an image diagram in a data-update period showing a partial display before update according to the first embodiment of the present invention.
Figure 3B:
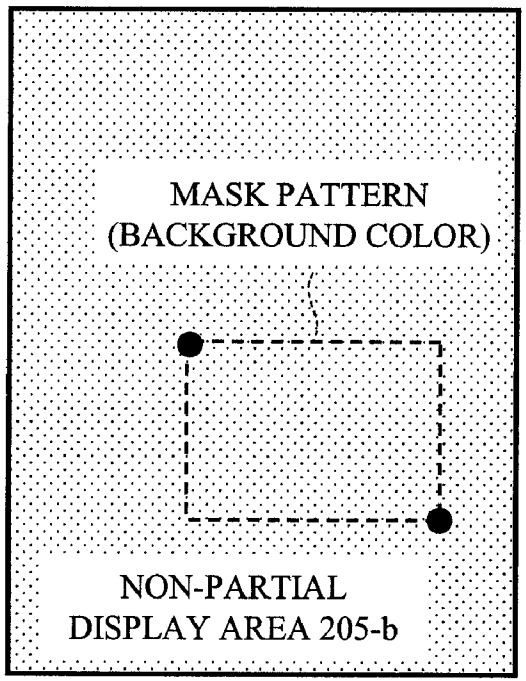
FIG. 3B is an image diagram in the data-update period showing a partial display during update according to the first embodiment of the present invention.
Figure 3C:
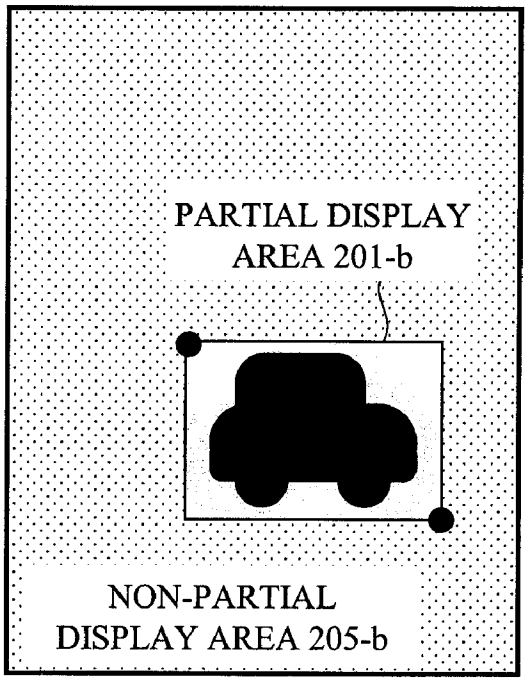
FIG. 3C is an image diagram in the data-update period showing a partial display after update according to the first embodiment of the present invention.

The improvement in display made by the mask switch 112 is described with reference to the image diagrams of FIG. 3. As similar to FIG. 6, FIG. 3A shows a partial display before update, FIG. 3B shows a partial display during data transfer with the partial-display area updated from 201-*a* to 201-*b*, and FIG. 3C shows a partial-display after update. Note that, correspondingly, the non-partial-display area is updated from 205-*a* to 205-*b*. As shown in FIG. 3B, masking prevents displaying distorted images while updating the display.

The display data outputted from the mask switch 112 is selected by the mode switch 113, and thereafter, processed by the alternate-current converter 114, the fetching latch 115, the synchronizing latch 116, and the DAC 117 similar to the normal mode, then the display data is displayed on the liquid crystal display 102.

The mode switch 113 implements control by setting the register for setting either the normal display mode or the partial-display mode in the setting register 106, according to the control by the MPU 104.

As described above, according to the present embodiment, changes in the partial-display area is detected by the setting command of partial-display area, the mask switch 112 is controlled so as to select the background pattern, besides, the write timing of the final line of the changed partial-display area in the partial memory 110 is determined by the address counter 108 which controls the partial memory 110, and the mask switch 112 is controlled so as to select image data in the partial memory 110 from the next frame. In this manner, the changes in the partial-display area is automatically detected so that the display will be the background pattern in the whole screen until the image data is switched after the change of partial-display area is set, thereby preventing display with distorted images.

Second Embodiment

A display device according to a second embodiment of the present invention will be described with reference to FIG. 4.

Figure 4:
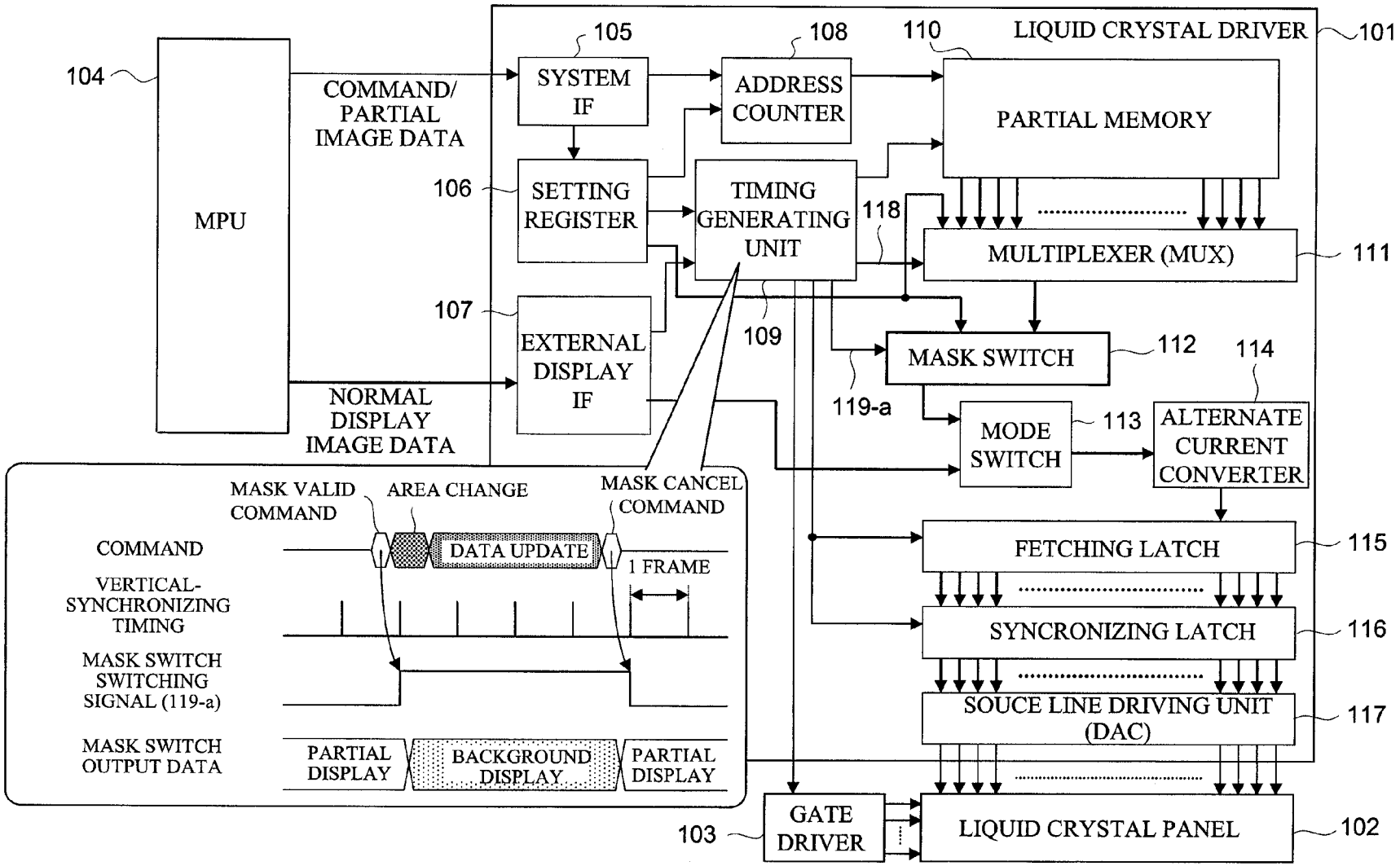
FIG. 4 is a block diagram showing a liquid crystal driver of a liquid crystal display according to a second embodiment of the present invention and a connection relation with external devices thereof.

FIG. 4 shows a liquid crystal driver of a liquid crystal display according to the second embodiment of the present invention and a connection relation with an external device thereof.

In the second embodiment, its block configuration is the same with FIG. 1 referred in the first embodiment and its operation is similar to that of the first embodiment. At the same time, a mask-switch-switching signal 119-*a* which controls the mask switch 112 as the switching means of the present invention is generated, and so it is a difference from the mask-switch-switching signal 119 in the first embodiment. Accordingly, the generation of the mask-switch-switching signal 119-*a* will be described.

The mask switch is controlled by the mask-switch-switching signal 119-*a* at the timing when receiving the mask validation command and the mask cancel command from the MPU 104. This can be achieved by providing a register to control the mask switch 112 and rewriting the register to control the mask switch 112 according to a command from the external such as the MPU 104.

The update of partial-display data and the update of the partial-display area are controlled by instructions from the MPU 104. Therefore, in the program of the update sequence of partial-display data, the mask validation command is added before the command for updating partial-display area, and the mask cancel command is added after the command for updating partial-display data so that the display distortion during updating the partial-display data is masked.

Further, by controlling the mask switch 112 according to the mask validation command and the mask cancel command, users will get more flexibility. For example, when there is not so many changes in the image, masking is not made during the whole period for updating the partial-display data, and the masking is canceled after a shorter period before the termination of updating display data to validate the partial-display so as to shorten the time to wait for the image to be switched. Such coordination from the MPU 104 side will be possible.

Still further, the masking period may be longer than the period of updated-data transfer. Moreover, when the mask-switch-switching signal 119-*a* is synchronized with the vertical-synchronizing timing of display output, the display will not be switched in the midst of displaying one screen.

In the manner described above, according to the present embodiment, the register capable of controlling according to external commands is provided, the mask switch 112 is controlled so as to select the background pattern while the partial-display area is changed. And when updating is terminated, the mask switch 112 is controlled so as to select the image data in the partial memory 110. Consequently, similar to the first embodiment, the display becomes the background pattern over the whole screen until the image data is switched after the change of partial data is set, thereby preventing displaying distorted image.

Third Embodiment

A display device according to a third embodiment will be described with reference to FIG. 5.

Figure 5:
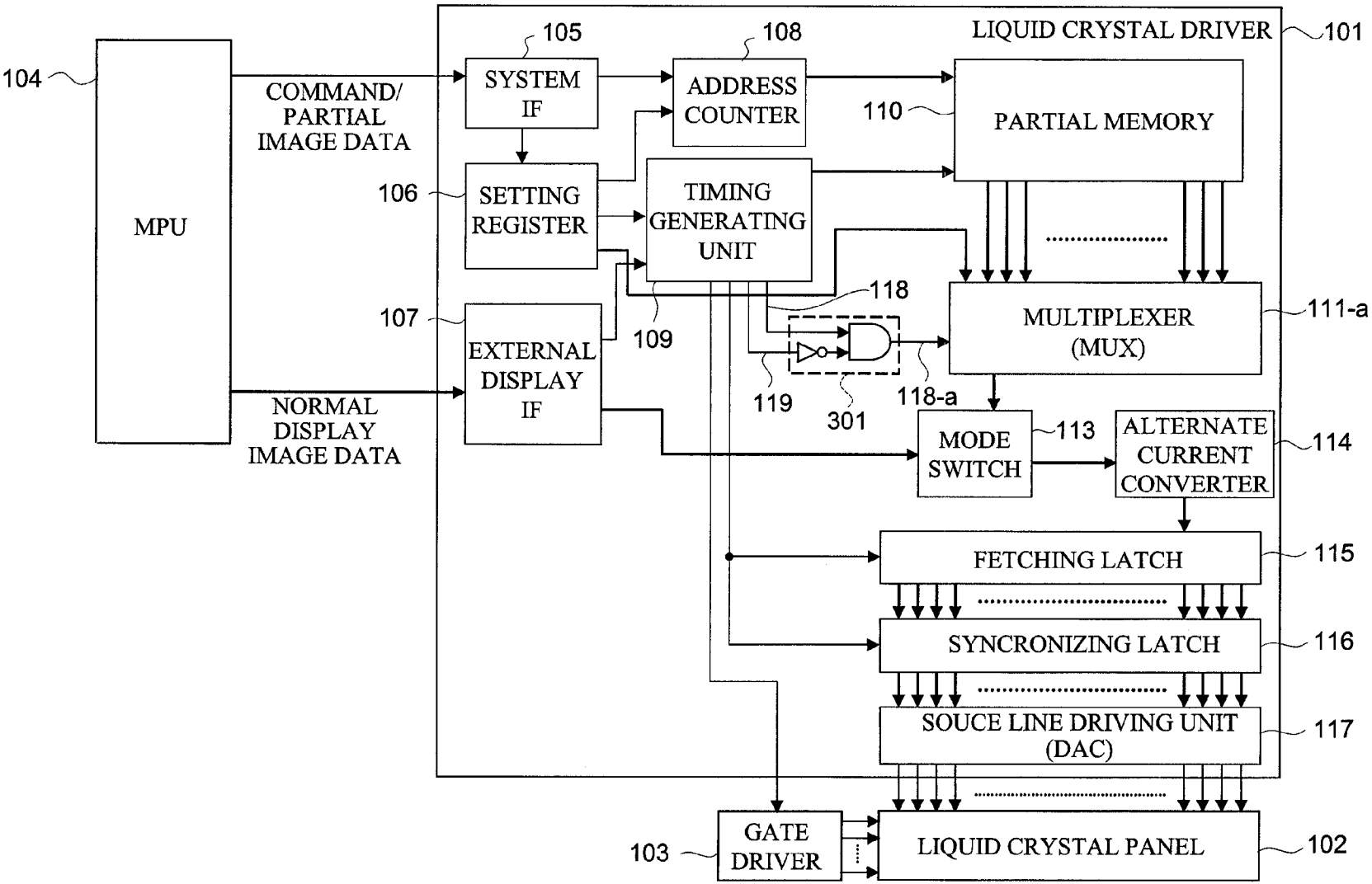
FIG. 5 is a block diagram showing a liquid crystal driver of a liquid crystal display according to a third embodiment of the present invention and a connection relation with external devices thereof.

FIG. 5 shows a block configuration of a liquid crystal driver of a liquid crystal display according to the third embodiment of the present invention and a connection relation with external devices thereof.

In the third embodiment, the mask switch 112 in FIG. 1 (first embodiment) and FIG. 4 (second embodiment) is used for both functions of switching partial validation period and the background pattern. Meanwhile, other operations and effects are the same with those of the first embodiment and the second embodiment.

In the third embodiment, a control-signal-masking circuit 301 as a masking means is added, which masks the partial-display timing 118 by the mask-switch-switching signal 119 and generates partial-display timing 118-*a* which does not validate displaying when updating the partial-display data. The control signal masking circuit 301 generates the partial-display timing 118-*a* so as to invalidate the partial-display timing 118 while the mask-switch-switching signal 119 is valid. By this means, the switching of the partial display and the background pattern of the MUX 111 is controlled and the background pattern is displayed during updating the partial-display data. In this case, the mask-switch-switching signal 119 may be generated internally by detecting the termination of update command of the partial-display area and data update of the first embodiment, and also by commands from externals such as the MPU 104 of the second embodiment.

As the third embodiment, equivalent effects are obtained in both the system for masking the partial-display timing, and the system for masking data by providing the mask switch of the first and second embodiments. Although examples where the mask switch is provided after the MUX 111 are described in the first and second embodiment, the mask switch 112 can be provided after the partial memory, such as after the output data of the partial memory and the alternate-current converter 114. Note that, if the mask switch is provided after the mode switch 113, it is required not to influence the normal mode. If providing the mask switch 112 after the alternate-current converter after the mode switch 113, it is required to add an alternate-current converter to the display of the background pattern.

In the foregoing, the present invention has been concretely described based on the foregoing embodiments. However, it is needless to say that the present invention is not limited to the foregoing embodiments and various modifications and alterations can be made within the scope of the present invention.

The present invention is applicable to display devices such as an active-matrix liquid crystal display having means of partial display, and organic EL displays. And further, the present invention can be used for display devices of mobile devices, such as mobile phones and handheld terminals.

What is claimed is:

1. A display driver capable of partial display comprising a memory to store display data, the display driver driving a display panel which includes a plurality of data lines and a plurality of scanning lines matrix-arranged and having a pixel at each crossing point thereof, wherein the display driver controls switching between a normal display mode for displaying an arbitrary image on a whole screen of the display panel and a partial mode for displaying the display data stored in the memory only on an arbitrary display area, wherein the partial mode allows changing the display data of an image to be stored in the memory and the arbitrary display area of the display data stored in the memory according to a command from an external device, and wherein the display driver further comprises a switching circuit which automatically switches displaying from a display pattern which is independent of the image size of the arbitrary display area and displayed while changing the display data of the image to be stored in the memory and the arbitrary display area of the display data stored in the memory to a display including the display data stored in the memory which is displayed after the change has ended.

2. The display driver according to claim 1, further comprising a generating circuit for generating timing to perform switching to display the display pattern when detecting a command to change the display data stored in the memory and the display area of the display data stored in the memory, and wherein the switching circuit is controlled by the timing generated by the generating circuit.

3. The display driver according to claim 1, further comprising a generating circuit detecting a status of writing to the memory and generating timing to perform switching to display the display data stored in the memory, wherein the switching circuit is controlled by the timing generated by the generating circuit.

4. The display driver according to claim 2, wherein the timing to switch the switching circuit is synchronized with a vertical-synchronizing signal of a display.

5. A display driving method allowing partial display, the display driving method comprising:

driving a display panel which includes a plurality of data lines and a plurality of scanning lines matrix-arranged and having a pixel at each crossing point thereof, controlling switching between a normal display mode for displaying an arbitrary image on a whole screen of the display panel and a partial mode for displaying the display data stored in a memory on an arbitrary display area, wherein the partial mode allows changing the display data of an image to be stored in the memory and the arbitrary display area of the display data stored in the memory according to a command from an external device, and wherein a display pattern which is independent of the image size of the display area and displayed while changing the display data of the image to be stored in the memory and the arbitrary display area of the display data stored in the memory is automatically switched to a display including the display data stored in the memory after the change has ended.

6. The display driving method according to claim 5, wherein a command to change the display data stored in the memory and the display area of the display data stored in the memory is detected to perform switching to display the display pattern.

7. The display driving method according to claim 5, wherein a status of writing to the memory is detected to perform switching to display the display data stored in the memory.

* * * * *